United States Patent [19]

Yates et al.

[11] 4,299,515

[45] Nov. 10, 1981

[54] ROCK REINFORCEMENT SYSTEM

[75] Inventors: Jan B. Yates, Reynoldsburg; Benjamin M. Bartilson, Columbus, both of Ohio

[73] Assignee: The Eastern Company, Naugatuck, Conn.

[21] Appl. No.: 112,522

[22] Filed: Jan. 16, 1980

[51] Int. Cl.[3] ..... E21D 20/02; F16B 20/02

[52] U.S. Cl. ..... 405/259; 405/261; 411/45

[58] Field of Search ..... 405/259-262; 411/45, 47, 48

[56] References Cited

U.S. PATENT DOCUMENTS

| | | | |
|---|---|---|---|
| 3,139,730 | 7/1964 | Williams et al. | 405/259 |
| 4,162,133 | 7/1979 | Clark et al. | 405/259 |
| 4,192,631 | 3/1980 | Vass | 405/261 |
| 4,194,858 | 3/1980 | Evans | 405/259 |

*Primary Examiner*—David H. Corbin

*Attorney, Agent, or Firm*—Charles S. McGuire

[57] ABSTRACT

A system for reinforcing a rock formation, such as in mining or tunneling operations, wherein an elongated bolt is anchored in a blind drill hole in the rock formation by both a mechanical expansion anchor and a resin grouting mix. The invention is particularly directed to novel means which prevent relative rotation of the bolt and anchor in one direction and allow relative rotation in the opposite direction, whereby a conventional, two-compartment resin cartridge can be broken and its contents mixed while rotating the bolt and anchor in the first direction, and the anchor expanded to tension the bolt by reversing the direction of rotation before the resin mix hardens. The novel means comprise a collar element which is affixed to the end of the bolt above the expansion anchor and cooperatively engages a stop means on the anchor in only one direction of bolt rotation. A number of alternative means are disclosed for affixing the collar to the bolt.

12 Claims, 10 Drawing Figures

ROCK REINFORCEMENT SYSTEM

BACKGROUND OF THE INVENTION

The present invention relates to rock reinforcing apparatus and, more specifically, to novel combined mechanical-resin rock bolt anchoring systems such as typically used in the support of mine roofs, and the like.

Among the more common means presently in use for reinforcing rock formations during mining, tunneling and excavating are elongated bolts or bars which are securely anchored in blind drill holes in the formation by mechanical expansion anchors, hardenable resin mixes which surround the end of the bolt within the hole, or both. Prior art systems employing a combination of mechanical and resin anchor means are discussed in U.S. Pat. No. 4,162,133, assigned to applicants' assignee, which discloses bolt anchoring apparatus and methods which involve common rotation of the bolt and an expansion anchor carried on the threaded end thereof to break a two-compartment resin package and mix the contents thereof. Cooperating structure associated with the bolt and/or anchor cause the two to be rotated together (i.e., relative rotation is prevented) when the bolt is turned in a counter-clockwise direction, tending to withdraw it from threaded engagement with the tapered nut of the expansion anchor. The cooperating structure, however, allows relative rotation in the opposite direction, whereby the anchor may be held stationary as the bolt is rotated in the opposite direction to draw the tapered nut into the hollow shell and effect expansion thereof. Thus, the bolt is anchored and tensioned prior to hardening of the resin mixture, which subsequently strengthens the bond between the bolt and rock formation.

Aforementioned U.S. Pat. No. 4,162,133 discloses a number of embodiments of means for rotationally locking the bolt and anchor in one direction of bolt rotation while permitting the anchor to be held stationary when the bolt is rotated in the opposite direction. An additional embodiment of such means is disclosed in copending application Ser. No. 945,225 of Gordon C. Evans, also assigned to applicants' assignee. The present invention is directed to, and has for a principal object the provision of, further novel embodiments of combined mechanical expansion and rein grouted rock bolt anchoring systems and, in particular, novel means for rotationally coupling a rock bolt and an expansion anchor threaded thereon in one direction of bolt rotation while allowing the anchor to be held rotationally stationary as the bolt is rotated in the opposite direction to effect expansion of the anchor.

SUMMARY OF THE INVENTION

A conventional mine roof bolt, having a head at one end and threaded for a portion of its length from the other end, is threaded through the tapered nut of an expansion anchor which includes a radially expansible, hollow shell. An annular collar is placed over and fixedly attached to the threaded end of the bolt which extends through the tapered nut. Several means are disclosed for attaching the collar to the bolt end, the preferred construction being inwardly extending splines on the collar which are embedded in the bolt threads as the collar is forcibly inserted thereon.

The surface of the collar facing the large end of the tapered nut carries a stop surface which, in the illustrated form, comprises a stepped shoulder at the terminus of a helical surface preferably having a lead angle equal to that of the bolt and nut threads. The large end of the tapered nut also carries stop means in the form of an integral boss or lug extending axially from the end of the nut. After the bolt is advanced through the tapered nut and the collar element is affixed to the bolt end, counterclockwise rotation of the bolt, tending to withdraw it from the nut, will cause the stop surface of the collar to engage the boss on the nut and rotationally lock the bolt and anchor during continued counterclockwise rotation. By reversing the direction of bolt rotation to clockwise, while rotationally restraining the anchor (as by frictional contact with the wall of the drill hole), upon a single revolution the bolt has axially advanced relative to the nut sufficiently that the stop means on the collar clears the boss on the nut. Thus, clockwise rotation of the bolt moves the nut axially into the hollow shell to expand it outwardly into firm engagement with the drill hole wall and tension the bolt.

DETAILED DESCRIPTION

Figure 1:
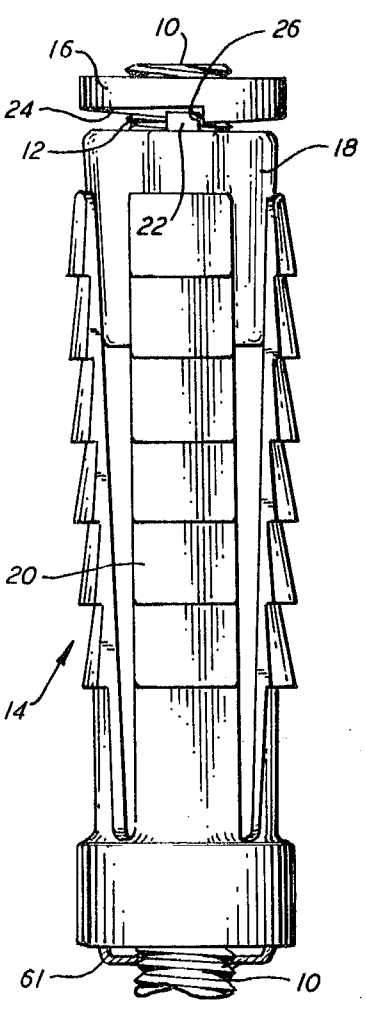
FIG. 1 is a fragmentary, elevational view of the threaded end of a rock bolt carrying an expansion anchor and collar element thereon.

Referring now to the drawings, in FIG. 1 is shown a fragment of a rock stabilizing assembly, full details of the construction and operation of which are disclosed hereinafter, including an elongated bolt 10 having threads 12 extending from one end thereof for a portion of its length. The assembly further includes a mechanical expansion anchor 14 and collar element 16. Anchor 14 may take any of a wide variety of previously known forms of such apparatus which include a wedge or tapered nut 18, having an internally threaded axial bore, and a hollow shell 20, comprising two or more radially expansible sections in the nature of elements usually termed leaves or fingers. Threads 12 mate with the internal threads of nut 18 and bolt 10 passes axially through anchor 14, being threadedly engaged through nut 18. It is assumed throughout that the threads on bolt 10 and nut 18 are standard, right-hand threads, whereby the bolt is advanced through the nut by clockwise rotation and withdrawn therefrom by counterclockwise rotation.

Anchor 14 is conventional in all respects, with the exception of lug or boss 22 which extends axially from the large end of nut 18. When nut 18 is of malleable cast iron, as is commonly the case, boss 22 may conveniently be formed integrally with the rest of the nut by a simple modification of the casting. Collar element 16 is an annular member which may also be malleable cast iron, or of other suitable material or fabrication, having a helical surface 24 on one side; in the illustrated construction, surface 24 is a single revolution helix, preferably having a lead angle equal to that of threads 12 and terminating in stepped shoulder 26.

Figure 2:
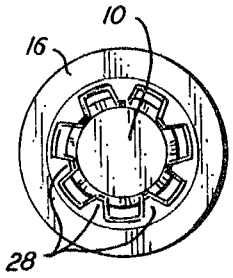
FIG. 2 is a plan view of the assembly of FIG. 1.

As seen in FIG. 2, collar 16 includes a plurality of integral, inwardly extending splines 28, the inner surfaces or edges of which lie on a circle having a diameter approximately equal to the diameter of bolt 10 at the root of threads 12. The inner diameter of collar 16, exclusive of splines 28, is approximately equal to the bolt diameter at the crest of threads 12. Collar 16 is permanently affixed to the end of bolt 10 by being forcibly inserted thereon so that splines 28 are embedded in threads 12, as seen in FIG. 2. Thus, collar 16, becomes rotationally integral with bolt 10. The direction of the helix of surface 24 is the same as that of threads 12, whereby counterclockwise rotation of bolt 10 brings the surface of stepped shoulder 26 into contact with the opposing surface of boss 22. Continued counterclockwise rotation of the bolt and collar will thus cause common rotation of anchor 14. However, when bolt 10 is rotated in the clockwise direction, with anchor 14 rotationally restrained as by frictional contact with the interior of a drill hole, after a single revolution shoulder 26 will clear boss 22. Thus, nut 18 will be moved axially down bolt 10 and expand shell 20.

As previously stated, the lead angle of the helix on collar 16 is preferably equal to that of threads 12. When this is the case, the collar may be engaged with the bolt at any rotational position relative to boss 22. Shoulder 26 will approach and contact boss 22 evenly without binding or glancing off as long as the elements are pressed into proper axial alignment at assembly. Without this feature it would be necessary to orient the collar both axially and rotationally.

Figure 3:
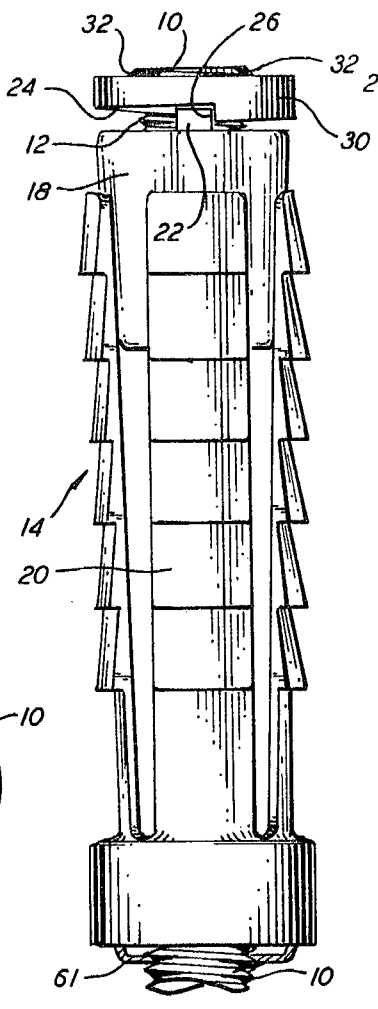

In FIG. 3 is shown an alternate construction of the collar element and the manner of attachment thereof to bolt 10. Reference numerals common to all Figures of the drawings are used for bolt 10, threads 12, anchor 14, nut 18 and boss 22, as well as for helical surface 24 and shoulder 26, which are identical in all illustrated constructions. Collar 30 is cylindrical on both its outer and inner surfaces. That is, collar 30 has no inwardly extending splines, as in the case of collar 16. The inner diameter of collar 30 is approximately equal to the diameter of the crests of threads 12. After bolt 10 is threaded into nut 18, collar 30 is placed over the end of the bolt with little or no interference, and is then permanently affixed to the bolt by one or more welds, indicated in FIG. 3 by reference numeral 32.

Figure 4:
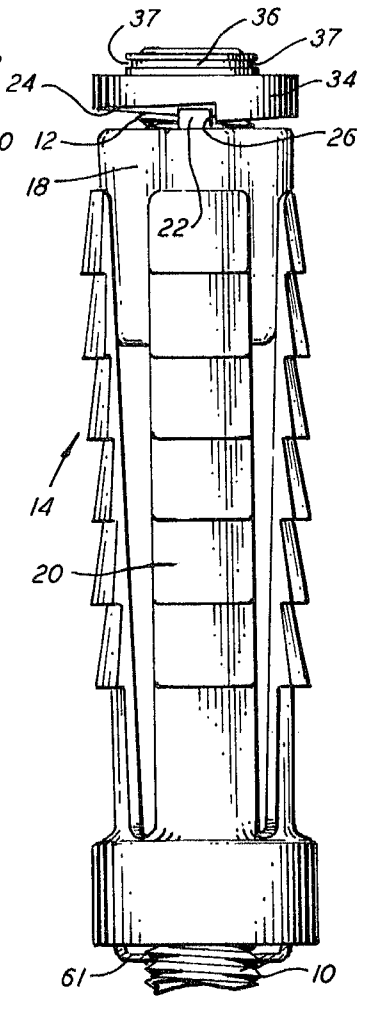

Collar element 34 of FIG. 4 includes an integral portion 36 of relatively thin, easily deformable material. After collar 34 is inserted over the end of bolt 10, portion 36 is struck with a crimping die at one or more points, as indicated at 37, to crimp both portion 36 and the underlying portion of threads 12 into permanently engaged relation. Collar 34 is thus rotationally fixed to bolt 10, and shoulder 26 will contact boss 22 upon counterclockwise rotation in the same manner as in the previously described constructions.

Figure 5:
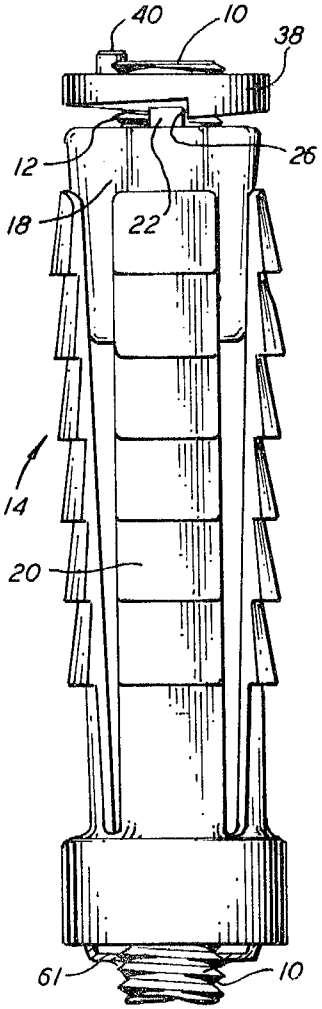
FIGS. 3–5 are fragmentary, elevational views of bolt, anchor and collar assemblies, as in FIG. 1, showing alternate means for attaching the collar element to the end of the bolt.
Figure 6:
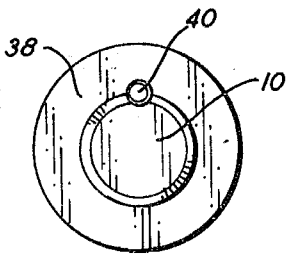
FIG. 6 is a plan view of the assembly of FIG. 5.

Turning now to FIGS. 5 & 6, still another construction which provides a rotational lock between the bolt and collar element is shown. Collar 38 is formed as an annular element having an inner diameter approximately equal to the diameter of bolt 10 at the crests of threads 12, as in the case of collar 30. A semi-circular groove is formed in collar 38 before the collar is inserted over the bolt end. Hardened pin 40 is driven into this opening and cuts a similar groove through bolt 10 by shearing off parts of the threads to retain the collar in rotationally fixed association with the bolt. Pin 40 can be installed in this manner with less force than that required to press splined collar 16 into engagement with the bolt threads.

Figure 7:
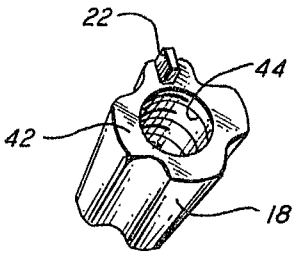
FIG. 7 is a perspective view of the tapered nut of the assemblies of all preceding Figures.

Nut 18 is shown in perspective view in FIG. 7, wherein boss 22 is seen projecting axially from surface 42, which forms the large end of the tapered nut, as well as internal threads 44.

Figure 10:
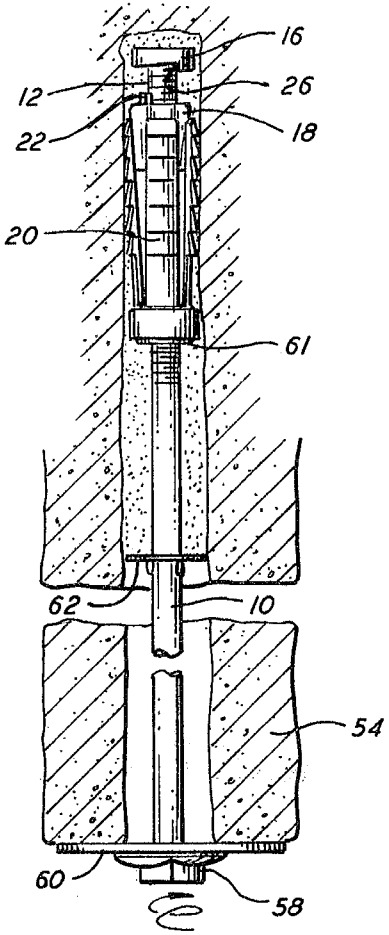
FIGS. 8–10 are a series of cross sectional views through a rock structure having a drill hole formed therein showing, in front elevation, the apparatus of the invention in various stages of installation.
Figure 9:
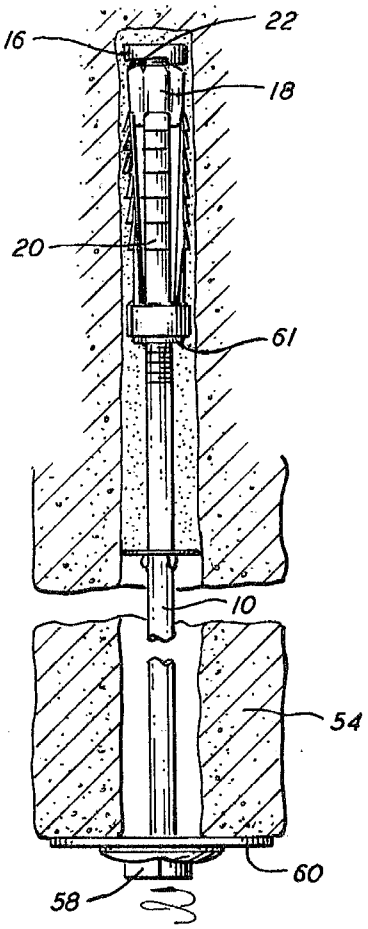
Figure 8:
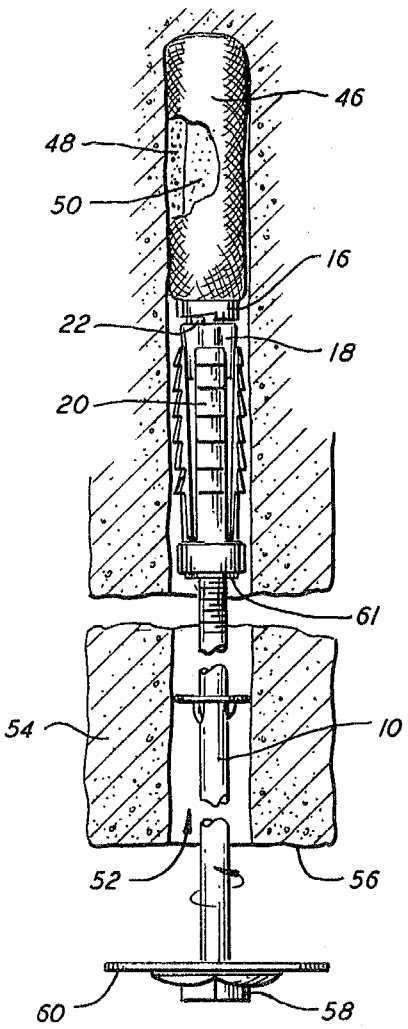

FIGS. 8–10 illustrate the operation of the invention to provide a combined mechanical-resin anchor for bolt 10. Conventional resin cartridge 46 includes two compartments physically separating components 48 and 50 of a resin grouting mix. Such cartridges are commercially available from a variety of sources and include a polyester resin as one of the components and a reaction agent such as a catalyst or curing or hardening agent as the other. The two components remain in a semi-liquid or thixotropic phase until mixed, whereupon the resin begins to solidify. Curing and solidification continue until an extremely strong bond is formed by the resin grout.

As seen in FIG. 8, cartridge 46 has been placed in blind drill hole 52 which has been previously formed in rock structure 54, such as the roof of a coal mine, for purposes of installing the elements which will serve to reinforce the rock structure and support surface 56 and the surrounding structure. Bolt 10 has an integral head 58 on the end opposite threads 12 which carries support plate 60. The bolt is placed into hole 52, with the expansion anchor 14 and collar element carried thereon, behind cartridge 46. Shell 20 is supported upon bolt 10 by Palnut 61, or any other such conventional means. Reference numeral 16 is used to denote the collar element of FIGS. 8–10, although it will be understood that any of the previously described constructions may be used without changing the operation of the invention. Head 58 is engaged by a socket tool (not shown) such as employed in bolting machines in coal mines and elsewhere, which is power driven to move the bolt upwardly into the drill hole and to rotate it in either direction. Threads 12 and those within nut 18 are of the right-hand type so that clockwise rotation of the bolt advances it into the nut as the latter is held rotationally stationary.

Bolt 10 is initially moved into drill hole 52 until cartridge 46 reaches the blind end of the hole, as shown in FIG. 8, and is continued to be moved axially and rotated in a counterclockwise direction, causing it to rupture cartridge 46 and mix components 48 and 50, as indicated in FIG. 9. It will be noted that the direction of spiral surfaces 24 and threads 12 are such that shoulder 26 opposes boss 22 during the counterclockwise rotation which is transmitted from the bolt to collar 16 due to the rotational lock between the bolt and collar. Thus, the counterclockwise rotation is also transmitted to expansion anchor 14 through the opposing shoulder 26 and boss 22 to cause the entire assembly to rotate as a single unit during mixing of the resin components. The resin mixture is retained in the upper end of drill hole 52 while in a flowable state by washer 62, of approximately the same diameter as the hole, supported by ears 64 on the shank of bolt 10.

After a sufficient amount of counterclockwise rotation to effect essentially even distribution and mixing of the resin components, the direction of rotation is immediately reversed to clockwise, as indicated in FIG. 10. The close fit of expansion shell 20 within drill hole 52 will tend to hold the anchor rotationally stationary. This is true, of course, in either direction of rotation, but the opposing engagement of shoulder 26 and boss 22 will overcome the frictional engagement between the walls of hole 52 and shell 20 during counterclockwise rotation. However, as may be seen in FIG. 10, clockwise rotation moves the shoulder 26 away from boss 22, allowing rotation of the bolt and collar relative to the nut and shell. Thus, since the bolt cannot move axially upward due to engagement of head 58 with plate 60, holding the expansion anchor rotationally stationary while rotating the bolt in a clockwise direction will move nut 18 downwardly along threads 12. This produces the desired radial expansion of shell 20, causing the latter to engage the wall of hole 52, as seen in FIG. 10. The bolt may be tensioned to the desired degree prior to the hardening of the resin grouting mix to an extend preventing further movement.

From the foregoing, it may be seen that the invention provides an effective and reliable anchor installation which fully utilizes all the advantages of both resin and mechanical type anchoring systems.

What is claimed is:

1. Mine roof bolt anchoring apparatus for use in conjunction with a conventional two-compartment resin grouting cartridge inserted into a blind drill hole in the mine roof ahead of said apparatus, the latter comprising, in combination:

(a) an elongated bolt having a head at one end and threaded for a portion of its length from the other end;

(b) an expansion anchor including a tapered nut having a threaded, axial bore for engagement with the threads of said bolt, and a hollow expansion shell to engage said nut with the smaller end thereof extending into the upper end of said shell;

(c) first stop means affixed to the larger end of said tapered nut and extending therefrom in an axial direction;

(d) a collar encircling and affixed to the threaded end of said bolt above said expansion anchor; and (e) second stop means affixed to the surface of said collar facing the larger end of said nut, and extending from said surface toward said larger end of said nut; whereby (f) upon counterclockwise rotation of said bolt, tending to withdraw the threaded end thereof from engagement with said nut, said second stop means contacts said first stop means and rotates said anchor with said bolt and collar, and upon clockwise rotation of said bolt with said anchor rotationally restrained, said bolt is advanced through said nut as said collar surface is moved away from said larger end of said nut to allow said second stop means to clear said first stop means, thereby moving said nut axially into said shell to effect expansion thereof against the wall of said drill hole.

2. The invention according to claim 1 wherein said first stop means comprises one side of a boss extending from said larger end of said tapered nut.

3. The invention according to claims 1 or 2 wherein said surface of said collar extends in a single revolution helix terminating in a stepped shoulder defining said second stop means.

4. The invention according to claims 1 or 2 wherein said surface of said collar extends in a single revolution helix having a lead angle substantially equal to that of the threads of said bolt and nut, and terminating in a stepped shoulder defining said second stop means.

5. The invention according to claims 1 or 2 wherein said collar includes a plurality of inwardly extending splines the inner edges of which lie on a circle having a diameter approximately equal to the diameter of said bolt at the root of the threads thereof, said collar being affixed to said bolt by force fit with said splines embedded in said bolt threads.

6. The invention according to claims 1 or 2 wherein said surface of said collar extends in a single revolution helix terminating in a stepped shoulder defining said second stop means, and a plurality of inwardly extending splines the inner edges of which lie on a circle having a diameter approximately equal to the diameter of said bolt at the root of the threads thereof, said collar being affixed to said bolt by force fit with said splines embedded in said bolt threads.

7. The invention according to claims 1 or 2 wherein the inner diameter of said collar is not less than the outer diameter of said bolt at the crests of the threads thereon, and further including a pin extending axially into an opening portions of which are defined by radially adjacent portions of said bolt and said collar, whereby said collar is affixed to said bolt by means of said pin.

8. The invention according to claims 1 or 2 wherein said surface of said collar extends in a single revolution helix terminating in a stepped shoulder defining said second stop means, and the inner diameter of said collar is not less than the outer diameter of said bolt at the crests of the threads thereon, and further including a pin extending axially into an opening portions of which are defined by radially adjacent portions of said bolt and said collar, whereby said collar is affixed to said bolt by means of said pin.

9. The invention according to claims 1 or 2 wherein said collar is welded to said bolt.

10. The invention according to claims 1 or 2 wherein said surface of said collar extends in a single revolution helix terminating in a stepped shoulder defining said second stop means, and said collar is welded to said bolt.

11. The invention according to claims 1 or 2 wherein the inner diameter of said collar is not less than the outer diameter of said bolt at the crests of the threads thereon, and said collar is radially crimped into permanently affixed relation with said bolt.

12. The invention according to claims 1 or 2 wherein said surface of said collar extends in a single revolution helix terminating in a stepped shoulder defining said second stop means, and the inner diameter of said collar is not less than the outer diameter of said bolt at the crests of the threads thereon, and said collar is radially crimped into permanently affixed relation with said bolt.

* * * * *